US010606181B2

(12) United States Patent
Srinivasan et al.

(10) Patent No.: US 10,606,181 B2
(45) Date of Patent: Mar. 31, 2020

(54) TONER COMPOSITIONS INCLUDING SILICA BLENDS AND METHOD TO MAKE THE SAME

(71) Applicant: Lexmark International, Inc., Lexington, KY (US)

(72) Inventors: Kasturi Rangan Srinivasan, Longmont, CO (US); Rick Owen Jones, Berthoud, CO (US); Courtney Harrison Soale, Lexington, KY (US); Devon Jean Vaccaro Strain, Shelbyville, KY (US); Ligia Aura Bejat, Lexington, KY (US)

(73) Assignee: Lexmark International, Inc., Lexington, KY (US)

( * ) Notice: Subject to any disclaimer, the term of this patent is extended or adjusted under 35 U.S.C. 154(b) by 720 days.

(21) Appl. No.: 14/142,373

(22) Filed: Dec. 27, 2013

(65) Prior Publication Data

US 2015/0185647 A1 Jul. 2, 2015

(51) Int. Cl.
*G03G 9/087* (2006.01)
*G03G 9/097* (2006.01)

(52) U.S. Cl.
CPC ..... *G03G 9/08711* (2013.01); *G03G 9/09708* (2013.01); *G03G 9/09716* (2013.01); *G03G 9/09725* (2013.01)

(58) Field of Classification Search
CPC .... G03G 9/00; G03G 9/0823; G03G 9/09708; G03G 9/09725
USPC ..... 430/108.6, 108.7, 123.51
See application file for complete search history.

(56) References Cited

U.S. PATENT DOCUMENTS

| | | | | |
|---|---|---|---|---|
| 4,837,101 | A * | 6/1989 | Gruber et al. | 430/109.3 |
| 5,175,070 | A | 12/1992 | Tanikawa | |
| 5,429,902 | A | 7/1995 | Saito | |
| 5,821,023 | A | 10/1998 | Shibuya | |
| 6,040,104 | A | 3/2000 | Nakamura | |
| 6,312,862 | B1 | 11/2001 | Okado | |
| 6,994,942 | B2 | 2/2006 | Miyakawa | |
| 2004/0067189 | A1 | 4/2004 | Sugiura | |
| 2004/0234881 | A1 | 11/2004 | Miyakawa | |
| 2005/0175918 | A1 | 8/2005 | Tomita | |
| 2006/0003244 | A1 | 1/2006 | Grande | |
| 2006/0286476 | A1 * | 12/2006 | Vanbesien et al. | 430/108.7 |
| 2007/0031749 | A1 | 2/2007 | Hu | |
| 2007/0048023 | A1 | 3/2007 | Thompson | |
| 2007/0190443 | A1 | 8/2007 | Hagi | |
| 2010/0040968 | A1 | 2/2010 | Bejat | |
| 2010/0040969 | A1 | 2/2010 | Bejat | |

* cited by examiner

*Primary Examiner* — Thorl Chea

(57) ABSTRACT

The toner composition of the present invention and method to make the same includes toner particles mixed with a specific set of extra particulate additives including large colloidal silica sized 90 nm to 120 nm and having a conductivity of less than 20 μs/cm in combination with medium size silica particles sized 30 nm to 60 nm. Optionally, additional extra particular additives such as silica sized 2 nm to 20 nm, alumina, titania or mixtures thereof can be used. The finished toner having these specific additives exhibited superior printing performance.

13 Claims, No Drawings

TONER COMPOSITIONS INCLUDING SILICA BLENDS AND METHOD TO MAKE THE SAME

STATEMENT REGARDING FEDERALLY SPONSORED RESEARCH OR DEVELOPMENT

None.

REFERENCE TO SEQUENTIAL LISTING, ETC.

None.

BACKGROUND

1. Field of the Invention

The present invention relates generally toner formulations including silica blends utilizing large colloidal silica sized 90 nm to 120 nm and having a conductivity of less than 20 μS/cm in combination with medium size silica particles sized 30 nm to 60 nm.

2. Description of the Related Art

Toners for use in electrophotographic printers may include two primary types, namely chemically prepared toners and toners made by a mechanical grinding process. Chemically prepared toners may have significant advantages over toners made by a mechanical grinding process. In a mechanical grinding process, particle breakage may be difficult to control and minimize. Also, the shape of mechanically ground particles may be more irregular than chemically prepared toner particles. Hence, the particle size distribution of mechanically ground toner particles may be relatively broader than for chemically prepared toner particles.

There are several types of chemically prepared toner, depending on the process used to make the chemically prepared toner. Chemically prepared toner may generally be classified as a suspension toner, an emulsion aggregation toner, a dispersion toner, or a chemically milled toner. Of the foregoing, a suspension toner is made by the simplest process. However, the shape of a suspension toner may be limited to spherical, and the size distribution of such toner may be dependent on how the toner ingredients are dispersed in a monomer used to make the toner. On the other hand, an emulsion aggregation toner may involve a more complex process. However, the emulsion aggregation process may provide a toner having a relatively narrower size distribution, and the shape and structure of the toner particles may be more controllable.

In a typical emulsion aggregation chemically prepared toner process, the toner components may include pigment, wax, and a latex binder which may be dispersed by use of surfactants. The toner may optionally include a charge enhancing additive or charge control agent.

One of the more important requirements of printers is print quality. In color laser printers, resolution may be very critical. Higher or better resolution may be achieved by using toner having a small particle size. Small particle size may be more difficult to achieve from a conventional toner processing technique, due to limitations in mechanical extruding/grinding. By preparing the toner chemically, a smaller particle size may be more readily obtained. As noted above, there may be at least two processes to prepare a chemical toner, i.e. a suspension polymerization, or an emulsion agglomeration process.

Toner may consist of a base particle and surface-borne extra particulate additives. These extra particulates may serve a variety of functions, may generally be submicron in size, and have a very high surface area. The high surface area of the extra particulate additives and morphology of the toner may tend to promote adhesion between the extra particulate additives and the toner particles. Thus, toner particles may be treated with smaller size particulate additives such as silicas, titanias, aluminas, other metal oxides, metal carbides or organic microspheres. The addition of these particulate additives may improve the charge stability, flow characteristics, and environmental stability of toner. Treatment of toner particles with additives may render the toner more stable at various temperature and humidity conditions. As the particulate additives may be physically held on the surface of the toner particle, there may be some additives which may be more difficult to dislodge from the toner particle, thereby affecting such toner properties as filming, charging, mass flow, and, in general, print quality.

SUMMARY OF THE INVENTION

The present disclosure is directed at a composition for improving the charge and charge stability of a toner composition by providing extra particular agents including medium silica ($SiO_2$) sized 30 nm to 60 nm, preferably sized 40 nm to 50 nm and large colloidal silica sized 90 nm to 120 nm and having a conductivity of less than 20 μS/cm ($SiO_2$) to the toner, and in particular, to the toner particle surface.

The present disclosure is directed to a method is provided for improving the charge characteristics of toner comprising mixing in a conical mixer a toner composition and a first extra particulate additive to form a mixture, wherein said toner composition comprises polymer material having a glass transition temperature (Tg) and said mixing is carried out wherein said mixture is raised to a temperature that does not exceed said Tg. This may be followed by screening said mixture. This then may be followed by adding additional extra particulate additives and mixing wherein the mixture is maintained at a temperature less than the Tg of the first extra particulate additive content is from 0.05 wt % to 1.0 wt % of the toner composition and wherein the additional extra particle additives comprise silica oxide and titania at a combined weight percent of less than 5% of the toner composition.

DETAILED DESCRIPTION

It is to be understood that the invention is not limited in its application to the details of construction and the arrangement of components set forth in the following description or illustrated in the drawings. The invention is capable of other embodiments and of being practiced or of being carried out in various ways. Also, it is to be understood that the phraseology and terminology used herein is for the purpose of description and should not be regarded as limiting. The use of "including," "comprising," or "having" and variations thereof herein is meant to encompass the items listed thereafter and equivalents thereof as well as additional items. Unless limited otherwise, the terms "connected," "coupled." and "mounted," and variations thereof herein are used broadly and encompass direct and indirect connections, couplings, and mountings. In addition, the terms "connected" and "coupled" and variations thereof are not restricted to physical or mechanical connections or couplings.

The present disclosure is directed at a composition and method for improving the charge and charge stability of a toner composition by providing extra particular agents including medium silica ($SiO_2$) sized 30 nm to 60 nm, preferably sized 40 nm to 50 nm and large colloidal silica sized 90 nm to 120 nm and having a conductivity of less than 20 μS/cm ($SiO_2$) to the toner, and in particular, to the toner particle surface. The toner particles may be prepared by a chemical process, such as suspension polymerization or emulsion aggregation. In one example, the toner particles may be prepared via an emulsion aggregation procedure, which generally provides resin, colorant and other additives. More specifically, the toner particles may be prepared via the steps of initially preparing a polymer latex from vinyl type monomers, such as acrylate based monomers or styrene-acrylate base copolymers, or polyester type polymers in the presence of an ionic type surfactant. The polymer latex so formed may be prepared at a desired molecular weight distribution (MWD=Mw/Mn) and may, e.g., contain both low and high molecular weight fractions to thereby provide a bimodal distribution of molecular weights. It may therefore be appreciated that the toner particles herein may utilize polymeric resins wherein the Mw/Mn may be in the range of 15-25, including all values and increments therein. In addition, the polymeric resins herein may include those resins that have a glass transition temperature of 40°-60° C. (as measured by DSC at a heating rate of about 10° C.·min, where Tg is taken as the midpoint of the change in reported heat capacity versus temperature output). Pigments may then be milled in water along with a surfactant that has the same ionic charge as that employed for the polymer latex.

Release agent (e.g. a wax or mixture of waxes) including olefin type waxes such as polyethylene may also be prepared in the presence of a surfactant that assumes the same ionic charge as the surfactant employed in the polymer latex. Optionally, one may include a charge control agent.

The polymer latex, pigment latex and wax latex may then be mixed and the pH adjusted to cause flocculation. For example, in the case of anionic surfactants, acid may be added to adjust pH to neutrality. Flocculation therefore may result in the formation of a gel where an aggregated mixture may be formed with particles of about 1-2 μm in size. Such mixture may then be heated to cause a drop in viscosity and the gel may collapse and relative loose (larger) aggregates, from about 1-25 μm, may be formed, including all values and ranges therein. For example, the aggregates may have a particle size between 3 μm to about 15 μm, or between about 5 μm to about 10 μm. In addition, the process may be configured such that at least about 80-99% of the particles fall within such size ranges, including all values and increments therein. Base may then be added to increase the pH and reionize the surfactant or one may add additional anionic surfactants. The temperature may then be raised to bring about coalescence of the particles. Coalescence is reference to fusion of all components. The toner may then be removed from the solution, washed and dried.

The resulting toner may have an average particle size in the range of 1 μm to 25 μm. The toner may then be treated with a blend of extra particulate agents, including medium silica sized 40 nm to 50 nm, large colloidal silica sized 90 nm to 120 nm and having a conductivity of less than 20 μS/cm, and optionally, alumina, small silica, and/or titania. Treatment using the extra particulate agents may occur in one or more steps, wherein the given agents may be added in one or more steps.

Medium silica may be understood as silica having a primary particle size in the range of 30 nm to 60 nm, or between 40 nm to 50 nm, prior to any after treatment, including all values and increments therein. Primary particle size may be understood as the largest linear dimension through a particle volume. The medium silica may be present in the toner formulation as an extra particulate agent in the range of 0.1% to 2.0% by weight of the toner composition, including all values and increments in the range of 0.1% to 2.0% by weight. The medium silica may also be treated with surface additives that may impart different hydrophobic characteristics or different charges to the silica. For example, the silica may be treated with hexamethyldisilazane, polydimethylsiloxane (silicone oil), etc. Exemplary silicas may be available from Evonik Corporation under the trade name AEROSIL and product numbers RX-50 or RY-50.

In one example, the medium silica may be treated with hexamethyldisilazane and the large colloidal silica may be treated with polydimethylsiloxane and vice versa. In another example, the medium silica may be treated with hexamethyldisilazane and the large colloidal silica may be treated with hexamethyldisilazane. In a further example, the medium silica may be treated with polydimethylsiloxane and the large colloidal silica may be treated with polydimethylsiloxane.

Large colloidal silica may be understood as silica having a primary particle size in the range of 70 nm to 120 nm, or between 90 nm to 120 nm, prior to any after treatment, including all values and increments therein. Most colloidal silicas are prepared as monodisperse suspensions with particle sizes ranging from approximately 30 nm to 100 nm in diameter. Polydisperse suspensions can also be synthesized and have roughly the same limits in particle size. Smaller particles are difficult to stabilize while particles much greater than 150 nm are subject to sedimentation. Whereas fumed silica tend to form agglomerates or aggregates, colloidal silica are dispersed more uniformly and in most cases dispersed as individual particles and have significantly fewer agglomerates or aggregates.

The large colloidal silica must also have a conductivity of less than 20 μS/cm. The large colloidal silica may be present in the toner formulation as an extra particulate agent in the range of 0.1 wt % to 2 wt %, for example in the range of 0.25 wt % to 1 wt % of the toner composition. The large colloidal silica may also be treated with surface additives that may impart different hydrophobic characteristics or different charges to the silica. For example, the large colloidal silica may be treated with hexamethyldisilazane, polydimethylsiloxane, dimethyldichlorosilane, dimethyldiethoxysilane octyltrialkoxysilane and combinations thereof, wherein the treatment may be present in the range of 1 wt % to 10 wt % of the silica. Exemplary large colloidal silicas may be available from Cabot Corporation under the trade names TGC110, TGC190 or TG243, or from Sukgyung AT Inc. under the trade name SGSO100C.

The alumina ($Al_2O_3$) that may be used herein may have an average primary particle size in the range of 5 nm to 20 nm, including between 8 nm to 16 nm (largest cross-sectional linear dimension). In addition, the alumina may be surface treated with an inorganic/organic compound which may then improve mixing (e.g. compatibility) with organic based toner compositions. For example, the alumina may include an octylsilane coating. The alumina may be present in the range of 0.01% to 1.0% by weight of the toner composition, including all values and increments therein, such as in the range of 0.01% to 0.25%, or 0.05% to 0.10% by weight. An example of the aluminum oxide may be that available from Evonik Corporation under the trade name AEROXIDE and product number C 805.

Small silica may be understood as silica ($SiO_2$) having an average primary particle size in the range of 2 nm to 20 nm, or between 5 nm to 15 nm (largest cross-sectional linear dimension) prior to any after treatment, including all values and increments therein. The small silica may be present in the toner formulation as an extra particulate agent in the range of 0.1% to 0.5% by weight, including all values and increments therein. In addition, the small silica may be treated with hexamethyldisilazane. Exemplary small silica may be available from Evonik Corporation under the trade name AEROSIL and product number R812.

In addition, titania (titanium-oxygen compounds such as titanium dioxide) may be added to the toner composition as a extra particulate additive. The titania may be present in the formulation in the range of about 0.2% to 1.0% by weight, including all values and increments therein. The titania may include a surface treatment, such as aluminum oxide. The titania particles may have a mean particle length in the range of 1.0 μm to 3.0 μm, such as 1.68 μm and a mean particle diameter in the range of 0.05 μm to 0.2 μm, such as 0.13 μm. An example of titania contemplated herein may include FTL-110 available from ISK USA.

The disclosed method to make the toner of the present invention operates to provide a finishing to toner particles, as more specifically described below. Such finishing may rely upon what may be described as a device for mixing, cooling and/or heating the particles which is available from Hosokawa Micron BV and is sold under the trade name "CYCLOMIX." Such device may be understood as a conical device having a cover part and a vertical axis which device narrows in a downward direction. The device may include a rotor attached to a mixing paddle that may also be conical in shape and may include a series of spaced, increasingly wider blades extending to the inside surface of the cone that may serve to agitate the contents as they are rotated. Shear may be generated at the region between the edge of the blades and the device wall. Centrifugal forces may therefore urge product towards the device wall and the shape of the device may then urge an upward movement of product. The cover part may then urge the products toward the center and then downward, thereby providing a feature of recirculation.

The device as a mechanically sealed device may operate without an active air stream, and may therefore define a closed system. Such closed system may therefore provide relatively vigorous mixing and the device may also be configured with a heating/cooling jacket, which allows for the contents to be heated in a controlled manner, and in particular, temperature control at that location between the edge of the blades and the device wall. The device may also include an internal temperature probe so that the actual temperature of the contents can be monitored.

For example, conventional toner or chemically prepared toner may be combined with one or more extra particulate additives and placed in the above referenced conical mixing vessel. The temperature of the vessel may then be controlled such that the toner polymer resins are not exposed to a corresponding glass transition temperature or Tg which could lead to some undesirable adhesion between the polymer resins prior to mixing and/or coating with the extra particulate additive material. Accordingly, the heating/cooling jacket may be set to a temperature of less than or equal to the Tg of the polymer resins in the toner, and preferably to a cooling temperature of less than or equal to about 25° C.

The conical mixing device with such temperature control may then be operated wherein the rotor of the mixing device may preferably be configured to mix in a multiple stage sequence, wherein each stage may be defined by a selected rotor rpm value (RPM) and time (T). Such multiple stage sequence may be particularly useful in the event that one may desire to achieve better distribution of the surface additives on the toner surface. In addition, such initial first stage of mixing may be controlled in time, such that the conical mixer operates at such rpm values for a period of less than or equal to about 60 seconds, including all values and increments therein. Then, in a second stage of mixing without removal of the toner from the conical mixer, the rpm value may be set higher than the rpm value of the first stage, e.g., at an rpm value greater than about 500 rpm. Furthermore, the time for mixing in the second stage may be greater than about 60 seconds, and more preferably, about 45-180 seconds, including all values and increments therein. For example, the second stage may therefore include mixing at a value of about 1300-1350 rpm for a period of about 90 seconds. Following the above mentioned blending the toner with surface additives can be subjected to a screening step or a classifying step to remove any undesired large agglomerates or particles. It may be appreciated that following the screening or classifying step the toner can be placed in the conical mixer and further blended to achieve better adhesion of the surface additives to the toner surface.

It can therefore be appreciated that with respect to the mixing that may take place in the present invention, as applied to mixing extra particulate additives with toner, such mixing may efficiently take place in multiple stages in a conical mixing device, wherein extra particulate additives may be added in a first stage wherein the breaking of aggregates may be accomplished, followed by screening, and then additional extra particulate additives are added before the toner is cooled. In addition, the temperature of the mixing process may again be controlled within such multiple staged mixing protocol such that the heating/cooling jacket and/or the polymer within the toner (as measured by an internal temperature probe) is maintained below its glass transition temperature (Tg).

It has been found that the mixing of toner particulate with extra particulate additive in the conical mixing device according to the above provides a relatively more uniform surface distribution of extra particulate additive.

The extra particulate additives may serve a variety of functions, such as to modify or moderate toner charge, increase toner abrasive properties, influence the ability/tendency of the toner to deposit on surfaces, improve toner cohesion, or eliminate moisture-induced tribo-excursions. The extra particulate additives may therefore be understood to be a solid particle of any particular shape. Such particles may be of micron or submicron size and may have a relatively high surface area with respect to the toner powder. The extra particulate additives may be organic or inorganic in nature. For example, the additives may include a mixture of two inorganic materials of different particle size, such as a mixture of differently sized fumed silica. The relatively small sized particles may provide a cohesive ability, e.g. the ability to improve powder flow of the toner. The relatively larger sized particles may provide the ability to reduce relatively high shear contact events during the image forming process, such as undesirable toner deposition (filming).

EXAMPLES

The examples herein are meant for illustrative purposes only and are not meant to limit the disclosure herein.

Various silica particles were utilized in the Examples herein, wherein the particles may incorporate various surface treatments. Table 1 outlines these particles, their respective average particle size prior to surface treatment and their surface treatments.

TABLE 1

| Extra Particulate Additive | Particle Size/ Method of Making | Surface Treatment |
|---|---|---|
| | Small Silica | |
| Aerosil R812 | 8 nm/Fumed | Hexamethyldisilazane |
| | Medium Silica | |
| Aerosil RX-50 | 40-50 nm/Fumed | Hexamethyldisilazane |
| Aerosil RY-50 | 40-50 nm/Fumed | Polydimethylsiloxane |
| | Large Colloidal Silica | |
| Silica 1 | 90-120 nm/Colloidal | 8 wt % Dimethyldiethoxysilane |
| Silica 2 | 90-120 nm/Colloidal | 4 wt % Hexamethyldisilazane/ 4 wt % Polydimethylsiloxane |
| Silica 3 | 90-120 nm/Colloidal | Octyltriethoxysilane |
| Silica 4 | 90-120 nm/Coiloidal | Hexamethyldisilazane |

Preparation of Example Toner 1

The above particles were added in various combinations to a base toner formulation of a styrene-acrylate based co-polymer having a Mn of 8,000, a Mw of 151.000 and a Tg of 51° C. The toner included a magenta pigment of about 5.1 wt % of PR122, 1.7 wt % of PR 184. In addition, a polyethylene wax release agent was present at about 4.8 wt % and a charge control agent was present at about 3.75 wt %.

The resulting base toner particles were blended in a cyclomix blender with 0.2 wt % small silica (AEROSIL R812) and 0.35 wt % of aluminum oxide (AEROXIDE C805). A second treatment step included adding medium silica and large colloidal silica, and 0.5 wt % of titania (FTL-10, available from ISK, USA). The medium silica and large colloidal silica were added to the toner composition as described below in Table 2.

TABLE 2

| Toner ID | Small Silica (wt %) | Aluminum Oxide (wt %) | Medium Silica (wt %) (RX-50) | Lame Colloidal Silica (wt %) | Titania (wt %) |
|---|---|---|---|---|---|
| Comparative Example 1 | 0.2 | 0.35 | 2 | 0 | 0.5 |
| Example 1a | 0.2 | 0.35 | 1.2 | 0.5 Silica 1 | 0.5 |
| Example 1b | 0.2 | 0.35 | 1 | 1 Silica 1 | 0.5 |
| Example 1c | 0.2 | 0.35 | 0.5 | 1.5 Silica 1 | 0.5 |

TABLE 2-continued

| Toner ID | Small Silica (wt %) | Aluminum Oxide (wt %) | Medium Silica (wt %) (RX-50) | Lame Colloidal Silica (wt %) | Titania (wt %) |
|---|---|---|---|---|---|
| Example 1d | 0.2 | 0.35 | 0 | 2 Silica 1 | 0.5 |
| Example 1e | 0.2 | 0.35 | 0.5 | 0.5 Silica 2 | 0.5 |
| Example 1f | 0.2 | 0.35 | 0.5 | 1.5 Silica 2 | 0.5 |
| Example 1g | 0.2 | 0.35 | 0 | 2 Silica 2 | 0.5 |

The above toner compositions were tested for cohesion, Epping charge, mass (m/a), charge for a given mass (Q/M), toner usage (mg/pg) and blotchy defect or mottle. The testing was performed in a printer for approximately 3,000 pages, in a relatively cold and relatively dry environment of 60*F and 8% relative humidity. Toner mass (Mass) was measured using a vacuum pencil and removing toner from the surface of a developer roll. It may be appreciated that for a given amount of toner for a selected area, (i.e. m/a or $mg/cm^2$) the toner may be charged to a level measured as microcoulombs/gram (μC/g). Accordingly, one may determine a value of charge per unit area by multiplying the value of (m/a)*(μC/g) to generate the toner charge in $uC/cm^2$. Cohesion may be understood as the powder flow of a toner, wherein lower cohesion provides relatively good flow behavior. Cohesion may be determined by placing a quantity of toner in a Hosakowa Micron powder flow tester. The device may include a nested stack of screens resting on a stage for a period of time, the amount of toner passing through the screens in the given time period is measured to calculate a cohesion value. Toner Usage (mg/pg) or 'TTU' corresponds to the amount of toner used in printing a required page and any undeveloped toner that was collected in a toner waste box. A mottle defect is observed when there is relatively non-uniform development of toner on an imaging substrate, such as paper. The defect arises from non-uniform transfer of toner from an initial imaging member to an imaging substrate, such as paper, resulting in non-uniform print density across the paper. The defect also appears to be lack of toner randomly across the paper, simulating a blotchy appearance. The blotchy appearance would appear to have areas with significantly different print density or L*, or L* greater than 3-4 units in adjacent areas. A rating of"severe" would correspond to the defect present in the entire page; "moderate" would correspond to a defect in more than one-half the page. "light" would correspond to the defect in some areas of the page. Epping charge which is a measure of the tribocharging characteristic of the toner was measured at ambient lab conditions. The results of these tests are illustrated in Table 3.

TABLE 3

| Toner ID | Cohesion | Epping Charge | Mass (m/a) ($mg/cm^2$) | Charge (Q/M) (μC/g) | Toner usage (TTU) (mg/pg) | Mottle Defect |
|---|---|---|---|---|---|---|
| Comparative Example 1 | 5.0 | −22.8 | 0.62 | −51.1 | 13.1 | Severe |
| Example 1a | 4.4 | −20.4 | 0.59 | −49.1 | 13.0 | Moderate |
| Example 1b | 4.7 | −16.9 | 0.54 | −45.8 | 11.0 | Light |
| Example 1c | 7.6 | −13.4 | 0.54 | −41.9 | 11.3 | None |
| Example 1d | 13.9 | −9.1 | 0.53 | −36.5 | 13.2 | None |
| Example 1e | 5.7 | −17.6 | 0.53 | −45.2 | 12.9 | Light |
| Example 1f | 7.3 | −11.1 | 0.47 | −39.6 | 13.5 | None |
| Example 1g | 4.8 | −7.1 | 0.51 | −32.2 | 19.3 | None |

As can be seen from the above, epping charge appears to decrease with an increase in the large colloidal silica concentration. Toner Examples 1d and 1g demonstrate a significantly lower toner charge due to the absence of medium sized silica. Low toner charge may also result in an increase in wrong-sign toner, toner that was undeveloped, and hence collected in a toner waste box, as seen in the case of Toner Examples 1g. The toner usage increased with the increase in the concentration of Silica 2. Evaluation of the print quality (Mottle Defect) reveals that in the absence of the large colloidal silica (Toner Comparative Example 1), the mottle defect is severe. However, the severity of the Mottle Defect is significantly lowered with the addition of the large colloidal silica to the toner. At blend ratios of 1/1 for the medium/large colloidal silicas (Example Toner 1b), the mottle defect is practically eliminated. Although the best Mottle Defect performance is observed for Toner examples 1d and 1g, the toner usage is high. This is not desirable. Toners were evaluated at a hot/humid environment (78° F./80% RH). Some toners with greater than 1.5% (example Toners 1f and 1g) large colloidal silica showed significantly high toner usage (>20 mg/pg), and prints exhibited very low print density or L*. This performance was rated unacceptable.

The importance of the presence of large colloidal silica as extra particular additives on the surface of toner particles can be seen Table 3, based on various silica described in Table 1. However, it may not be obvious to one skilled in the art that the toner usage or TTU is influenced by the silica type and size. Evaluations of large colloidal silica that varied in conductivity significantly impacted the toner usage, i.e. the toner to cleaner amounts. Example Toner 2 was prepared in a similar method used to prepare Example Toner 1. Conductivity for the large colloidal silica was measured by dispersing 0.5 g of large colloidal silica in a 1:1 mixture of water and methanol, and shaken in a hand wrist shaker for about 5 minutes. Using a pH meter or any other suitable device, the conductivity of the water/methanol mixture was measured, and reported as S/Cm. Further, the large colloidal silica slurry in a water/methanol mixture (1:1) was filtered and dried at 130° C./36 hrs, and used as a surface additive to be blended with the toner. Only a single wash was carried out to study the role of the conductivity on toner usage. Conductivity was measured for both the as-is (unwashed) and washed samples and are shown in the following table, along with evaluation of the said toners in a printer for the toner usage as a function of large silica conductivity:

TABLE 4

Conductivity Test Result

| Toner ID | Large Colloidal Silica conductivity (μS/cm) Unwashed/Washed | Toner usage (mg/pg) Unwashed/Washed |
|---|---|---|
| Comparative Example 2 | 15.9/4.9 | 18.4/16.5 |
| Example 2a | 375/49.4 | 23.5/19.8 |
| Example 2b | 815/420 | 36.9/24.9 |
| Example 2c | 41.4/N/A | 26.2/N/A |

As is seen in Table 4, as the conductivity of the silica is increased, toner usage is increased. This is not acceptable. The washing process does tend to lower the conductivity and accordingly lowers the toner usage. The preferred conductivity for the silica should be about 20 μS/cm or less.

The impact of the conductivity of the large silica obtained by a colloidal process is further evident when evaluated in a dual component development system. In a dual component development system, a magnetic particle typically based on a manganese-ferrite core is used to charge the toner particle in a triboelectric manner. The toner tribocharge thus achieved is also influenced by the environment, typically a lower tribocharge is obtained at a hot/humid environment in comparison to a higher tribocharge at a cold/dry environment. As the toner tribocharge is lowered, the possibility of increasing wrong sign toner is increased, which can result in a toner cloud or toner dust. The following table illustrates the possibility of creating a toner cloud or dust. Evaluation corresponds to forming a developer mix comprising of about a ferrite-manganese carrier with about 8% of the polyester toner. A typical polyester toner preparation may be found in US 2013017155. More specifically a typical polyester toner preparation would include the following steps. Low Tg and an medium Tg Amorphous Polyester Resin Emulsion and the Example High Tg Amorphous Polyester Resin Emulsion are used in a ratio of 18:47:35 (wt), with a core to shell ratio of 60:40 (wt.). Components were added to a 500 liter reactor in the following relative proportions: About 15.2 parts (polyester by weight) of a low Tg amorphous Polyester Emulsion, 39.7 parts by weight of a medium Tg amorphous polyester emulsion, 4.3 pans (pigment by weight) of the Example Cyan Pigment Dispersion, 11.25 parts (release agent by weight) of the Wax Emulsion was placed in a 5 Liter reactor vessel, deionized water was then added so that the mixture contained about 12% to about 15% solids by weight. The mixture was heated in the reactor to 25° C. and a circulation loop was started consisting of a high shear mixer set at 10,000 rpm and an acid addition pump. Acid (about 1% sulfuric acid solution) was slowly added to the high shear mixer. The temperature of the reactor was increased to about 40° C.-45° C. Once the particle size reached 4.05 μm to 5.0 μm (number average), 4% (wt.) borax solution was added. After the addition of borax, 29.5 parts (polyester by weight) of a High Tg Amorphous Polyester Resin Emulsion was added to form the shell. Once the particle size reached 5.5 μm (number average), 4% NaOH was added to raise the pH to about 6.89 to stop the particle growth. Once particle growth stopped, the temperature was increased to 82° C. to cause the particles to coalesce. This temperature was maintained until the particles reached their desired circularity (about 0.97). The toner was then washed and dried.

The dried toner had a volume average particle size of 6.26 μm, measured by a COULTER COUNTER Multisizer 3 analyzer and a number average particle size of 5.28 μm. Fines (<2 μm) were present at 0.50% (by number) and the toner possessed a circularity of 0.985, both measured by the SYSMEX FPIA-3000 particle characterization analyzer, manufactured by Malvern Instruments, Ltd., Malvern, Worcestershire UK. The developer mix was prepared in a turbula type mixer. Toner was surface treated with a small silica like Aerosil R812, a medium silica like RX50, and a large colloidal silica. Large silica corresponds to a silica prepared via a colloidal or sol•gel process, and treated with a reactive silane such as SGSO100C commercially available from Sukgyung AT Inc. or TGC110, TGC190 or TGC243 commercially available from Cabot Corporation. Test was carried out on a bench top robot fixture wherein the developer mix was churned at a certain speed for about 10K pages in a hot/humid environment. Tribocharge measurements were carried out at 0K pages (initial) and at 10K pages. Following an overnight rest, charge was again measured. Toner dusting measurement corresponds to a qualitative estimation of amount of toner collected on a paper that was placed close to a lid of the churn robot and visual observation of amount of toner expelled. Light dusting would correspond to a few toner particles on the paper, whereas a severe dusting would cover the paper entirely.

TABLE 5

Toner dusting behavior at hot/humid environment (78° F./80% RH) for large colloidal silica type and its conductivity

| Toner ID | Polyester Toner Pigment | Large Colloidal Silica | Large Colloidal silica Conductivity | Q/M (μC/g) @ 0K pages | Q/M (μC/g) @ 10K pages | Q/M (μC/g) @ 10K pages/ 16 hrs | Toner dusting |
|---|---|---|---|---|---|---|---|
| Comparative Example 3 | Cyan | Silica 1 | 10 μS/cm | −41 | −36 | −29 | Medium |
| Example 3a | Cyan | Silica 3 | 144 μS/cm | −36 | −24 | −18 | Severe |
| Comparative Example 4 | Magenta | Silica 1 | 10 μS/cm | −41 | −39 | −29 | Medium |
| Example 4a | Magenta | Silica 1 | 5010 μS/cm | −29 | −24 | −19 | Very Severe |
| Example 4b | Magenta | Silica 3 | 144 μS/cm | −39 | −39 | −34 | Very Severe |
| Example 4c | Magenta | Silica 4 | 12 μS/cm | −31 | −21 | −15 | Light |

As is evident from the Table 5, the tribocharge of the toner is lowered in the presence of colloidal silica that inherently has a higher conductivity. Also, the high conductivity silica increases the tendency to form toner clouds as a developer mix is worked in a developer sump. This is evident from Examples 3a, 4a and 4b. However, the toner dusting is light to medium when the colloidal silica has a lower conductivity.

The foregoing description of several methods and an embodiment of the invention has been presented for purposes of illustration. It is not intended to be exhaustive or to limit the invention to the precise steps and/or forms disclosed, and obviously many modifications and variations are possible in light of the above teaching. It is intended that the scope of the invention be defined by the claims appended hereto.

What is claimed is:

1. A toner composition, comprising:

toner particles;

medium sized silica particles combined with said toner particles having a primary particle size in the range of 30 nm to 60 nm and present in the range of 0.1 to 2.0% wt of the toner composition; and large sized colloidal silica particles combined with said toner particles having a primary particle size in the range of 90 nm to 120 nm and having a conductivity less than 20μS/cm and present in the range of 0.1 to 2% by weight of the toner composition .

2. The toner composition of claim 1, wherein said medium sized silica particles are treated with a surface treatment selected from the group consisting of hexamethyldisilazane and polydimethylsiloxane.

3. The toner composition of claim 1, wherein said large sized colloidal silica particles are treated with a surface treatment selected from the group consisting of hexamethyldisilazane, polydimethylsiloxane, dimethyldichlorosilane, dimethyldiethoxysilane octyltrialkoxysilane and combinations thereof.

4. The toner composition of claim 1, further comprising alumina particles present in the range of 0.01% by 1.0% by weight of the toner composition.

5. The toner composition of claim 4, wherein said alumina particles are surface treated with octylsilane.

6. The toner composition of claim 1, further comprising small sized silica particles having a primary particle size in the range of 2 nm to 20 nm present in the range of 0.1% to 0.5% by weight of the toner composition.

7. The toner composition of claim 1, further comprising the titania particles present in the range of 0.2% to 1.0% by weight.

8. The toner composition of claim 7, wherein said titania particles are surface treated with aluminum oxide.

9. The toner composition of claim 1, wherein said toner particles comprise a styrene-acrylate based copolymer resin.

10. The toner composition of claim 1, wherein said toner particles comprise a polyester based resin.

11. The toner composition of claim 1, wherein said large sized colloidal silica particles are present in the range of 0.25% to 2% by weight of the toner composition.

12. The toner composition of claim 1, located in a printer cartridge.

13. A toner composition, comprising:

toner particles combined with a set of extra particular additives including medium sized silica particles treated with a surface treatment selected from the group consisting of hexamethyldisilazane and polydimethylsiloxane having a primary particle size in the range of 30 nm to 60 nm and present in the range of 0.1 to 2.0% wt of the toner composition, large sized colloidal silica particles having a primary particle size in the range of 90 nm to 120 nm and having a conductivity less than 20μS/cm and present in the range of 0.25% to 1.0% by weight of the toner composition, small sized silica particles having a primary particle size in the range of 2 nm to 20 nm and present in the range of 0.1% to 0.5% by weight of the toner composition, alumina particles surface treated with octylsilane and present in the range of 0.01% by 1.0% by weight of the toner composition; and titania particles surface treated with aluminum oxide and present in the range of 0.2% to 1.0% by weight of the toner composition.

* * * * *